US005792388A

United States Patent [19]

Heitz et al.

[11] Patent Number: 5,792,388

[45] Date of Patent: Aug. 11, 1998

[54] CHEMICALLY-MODIFIED SILYL-TERMINATED POLYTHIOETHER-DIISOCYANATE POLYMERS, COMPOSITIONS AND PROCESSES

[75] Inventors: Roger M. Heitz, Palos Verdes Estates; Leon Burks, Jr., Los Angeles; Nicholas T. Castellucci, Lomita, all of Calif.

[73] Assignee: Northrop Grumman Corporation, Los Angeles, Calif.

[21] Appl. No.: 663,399

[22] Filed: Jun. 13, 1996

[51] Int. Cl.[6] ..... H01B 1/20; H01B 1/22

[52] U.S. Cl. ..... 252/514; 252/520.2; 252/521.5; 252/500

[58] Field of Search ..... 252/500, 512, 252/514, 520.2, 521.5; 528/28, 76

[56] References Cited

U.S. PATENT DOCUMENTS

| | | | |
|---|---|---|---|
| 4,020,033 | 4/1977 | Dannels | 260/31.8 Z |
| 4,366,307 | 12/1982 | Singh et al. | 528/373 |
| 4,728,712 | 3/1988 | Singh et al. | 528/75 |
| 4,960,844 | 10/1990 | Singh | 528/17 |
| 5,250,651 | 10/1993 | Price | 528/59 |
| 5,429,772 | 7/1995 | Castellucci et al. | 252/514 |
| 5,525,262 | 6/1996 | Castellucci et al. | 252/514 |

*Primary Examiner*—Mark Kopec
*Attorney, Agent, or Firm*—Terry J. Anderson; Karl J. Hoch, Jr.

[57] ABSTRACT

The present process involves forming the following mixtures of ingredients as parts A, B, C, D and E:

Part A:
1. diethyl toluene diamine (Reactant)
2. 1-methoxy-2-propanol acetate (Solvent/Reactant)

Part B:
1. 1-methoxy-2-propanol acetate (Solvent)
2. silyl polythioether polymer/methylene bis 4-cyclohexyl isocyanate (Reactant)

Part C:
1. benzyl phthalate (or other liquid plasticizer)

Part D:
1. N-beta (aminoethyl)-γ-aminopropyltrimethoxy silane (liquid Reactant)

Part E:
1. Ag-coated hollow filler spheres.

These mixtures are combined in the following steps:

Step I—Combine Part C with Part D and mix thoroughly (no Reaction);

Step II—Add Part B and mix well (Reaction);

Step III—Add Part E, and mix well;

Step IV—Add Part A and mix well (Reaction);

Chemical reactions take place, when the above chemical compounds are added in the sequence indicated, to form a novel self-curing elastomeric composition.

2 Claims, 5 Drawing Sheets

MIXING STEP III
SILVER-COATED MICROSPHERES (PART E) WERE ADDED
FIG.3
MIXING STEP IV
PART A IS ADDED TO PARTS B,C,D+E
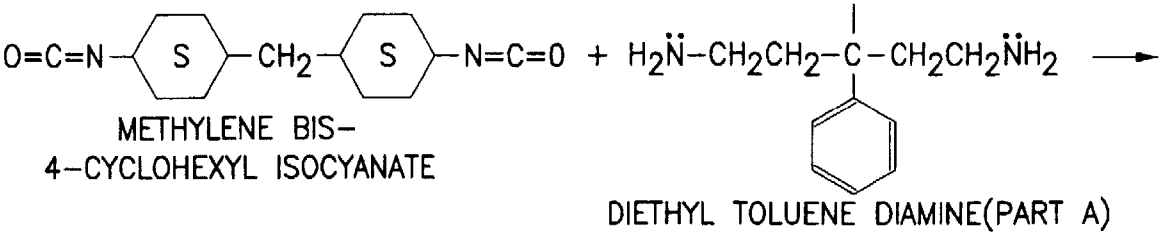
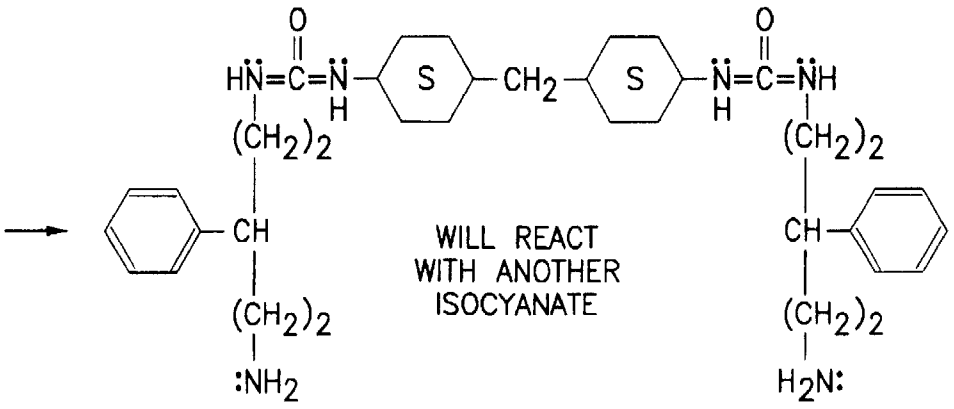
FIG.4

CHEMICALLY-MODIFIED SILYL-TERMINATED POLYTHIOETHER-DIISOCYANATE POLYMERS, COMPOSITIONS AND PROCESSES

BACKGROUND OF THE INVENTION

1. Field of the Invention

The present invention relates to novel chemically modified silyl-terminated polythioether polymers and curable gap-filling, conductive compositions in which the polythioether is a liquid which is curable at room temperature to form an elastomer having good elongation, low-shrinkage and having good adhesion to metallic surfaces such as aluminum and titanium alloys and composite surfaces, and/or to epoxy primer coatings applied to such surfaces. Such compositions are well suited for use in filling gaps, cracks or other narrow spaces in metallic, polymeric, composite and/or epoxy, polyurethane, or acrylic-primed surfaces since they are light in weight, they bond to such surfaces during rapid curing at room temperatures as well as at elevated temperatures, they provide improved conductive filler properties at very low temperatures, down to −65° F., and they form smooth rubbery deposits having excellent water resistance and corrosion resistance, expansion-and-contraction properties and resistance to cracking. They are also sprayable if diluted with suitable solvents.

2. Discussion of the Known Art

Polythioether elastomer compositions are well known gap-filling compositions, having advantages over polyurethane, epoxy and silicone elastomers with respect to improved adhesion and cohesion, shrink resistance, elongation and other properties which are important to the end use:

Reference is made to U.S. Pat. Nos. 4,020,033 and 4,728,712 for their disclosure of curable mercaptan-terminated polythioether elastomer sealant compositions. Reference is made to U.S. Pat. No. 4,960,844 for its disclosure of curable silyl-terminated polythioether elastomer caulking or gap-filling compositions. Reference is made to U.S. Pat. No. 5,250,651 for its disclosure of curable polyetherisocyanate polyurethane sealant compositions.

Various of the prior known curable elastomer compositions have one or more acceptable properties required for their intended use as gap-fillers, such as electrical conductivity, durability, corrosion-resistance, toughness, flexibility, elongation, shrink-resistance, low curing time at ambient temperatures, appropriate hardness, crack-resistance under tension and compression, fatigue-resistant at low temperatures (−45° F. to −65° F.), stability at temperatures down to −65° F., lightweight, low cost, safe to handle and electroconductive when it contains a minor wt. % of conductive filler, less than about 45% by weight of the total composition. However, the known compositions are deficient with respect to several of the required properties listed above and therefore represent a compromise.

Some of the known gap-fill compositions require the incorporation of major amounts by weight of conductive nickel filler, about 70% by weight, which increases the weight and reduces the flowability of the composition, and increases the curing time to several weeks at ambient temperature.

Hydroxy-terminated polythioether elastomer compositions possess many of the required properties but their curing time at ambient temperatures is very long, i.e., a few weeks.

In summary, none of the known gap-fill or sealant compositions possess all of the aforementioned desired properties, and it is the main objective of the present invention to provide novel gap-fill compositions which do possess all of said properties.

SUMMARY OF THE INVENTION

The present invention relates to a novel process for producing novel chemically-modified silyl-terminated polythioether/methylene-bis-4-cyclohexyl isocyanate elastomers and gap-fill electroconductive compositions based upon such novel elastomers, which compositions have a short cure time at ambient temperatures, excellent flexibility and elongation, high electroconductivity, excellent flow and levelling properties for the filling of gaps, high adhesion or bonding strength for surfaces such as aluminum or composite surfaces and primer coatings thereover, low shrinkage, abrasion resistance and good fatigue resistance at temperatures as low as −65° F.

Applicants have discovered that the final chemistry of silyl-terminated polythioether/methylene-bis-4-cyclohexyl isocyanate polymers and the properties of conductive compositions based upon such polymers as binder materials, is dependent upon the sequence in which the reactants/ingredients of the composition are mixed with each other, enabling certain chemical reactions to be initiated between reactants which are more reactive with other ingredients if they were co-present. Thus, by excluding some of the more reactive ingredients until certain other ingredients have been mixed and/or reacted with each other it has been discovered that the present silyl-terminated polythioether/methylene-bis-4-cyclohexyl isocyanate polymers and compositions can be chemically-modified to provide them with new and improved properties of rapid curing at ambient temperatures, good elongation and flexibility, low shrinkage, electrical conductivity, flowability and excellent adhesion properties.

DRAWING

The accompanying drawing, FIGS. 1, 2*a*–2*c*, 3, and 4 illustrate the critical sequence of mixing and reaction steps for carrying out the present process for producing the novel, rapidly-curable electroconductive silyl-terminated polythioether/methylenebis-4-cyclohexyl isocyanate elastomer compositions of the present invention.

DETAILED DESCRIPTION

Figure 1:
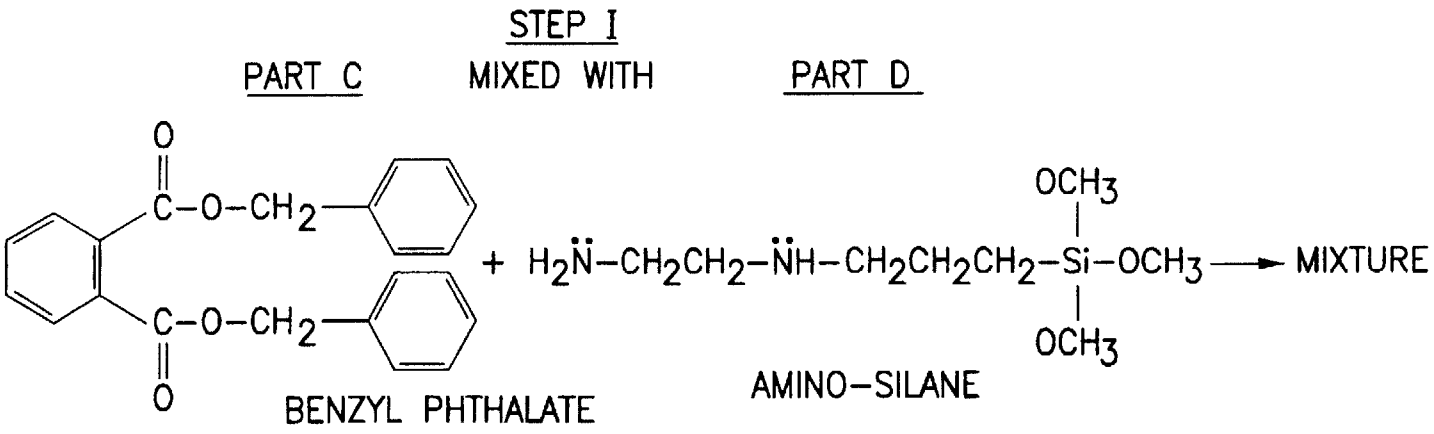
Figure 2A:
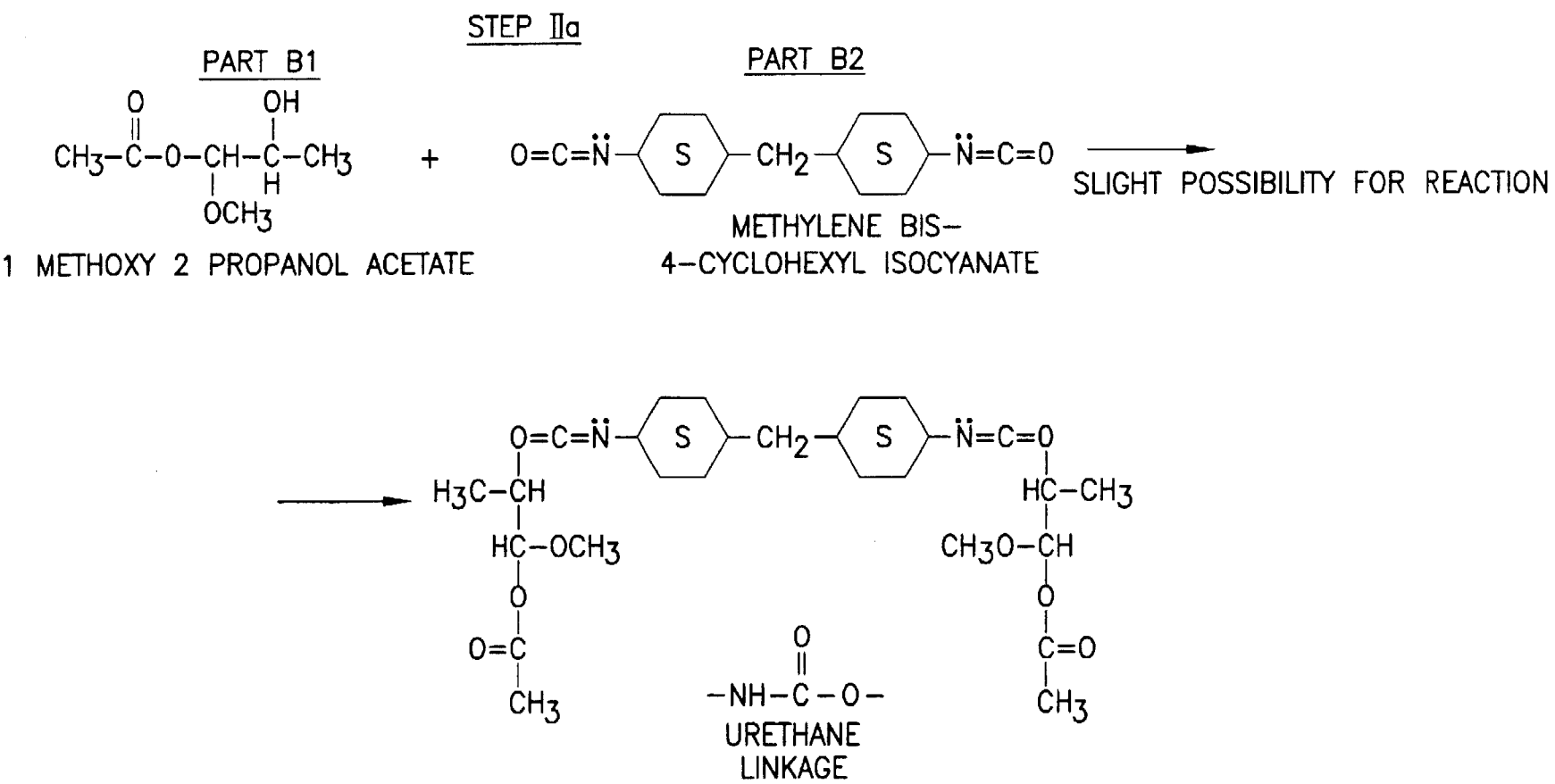
Figure 2B:
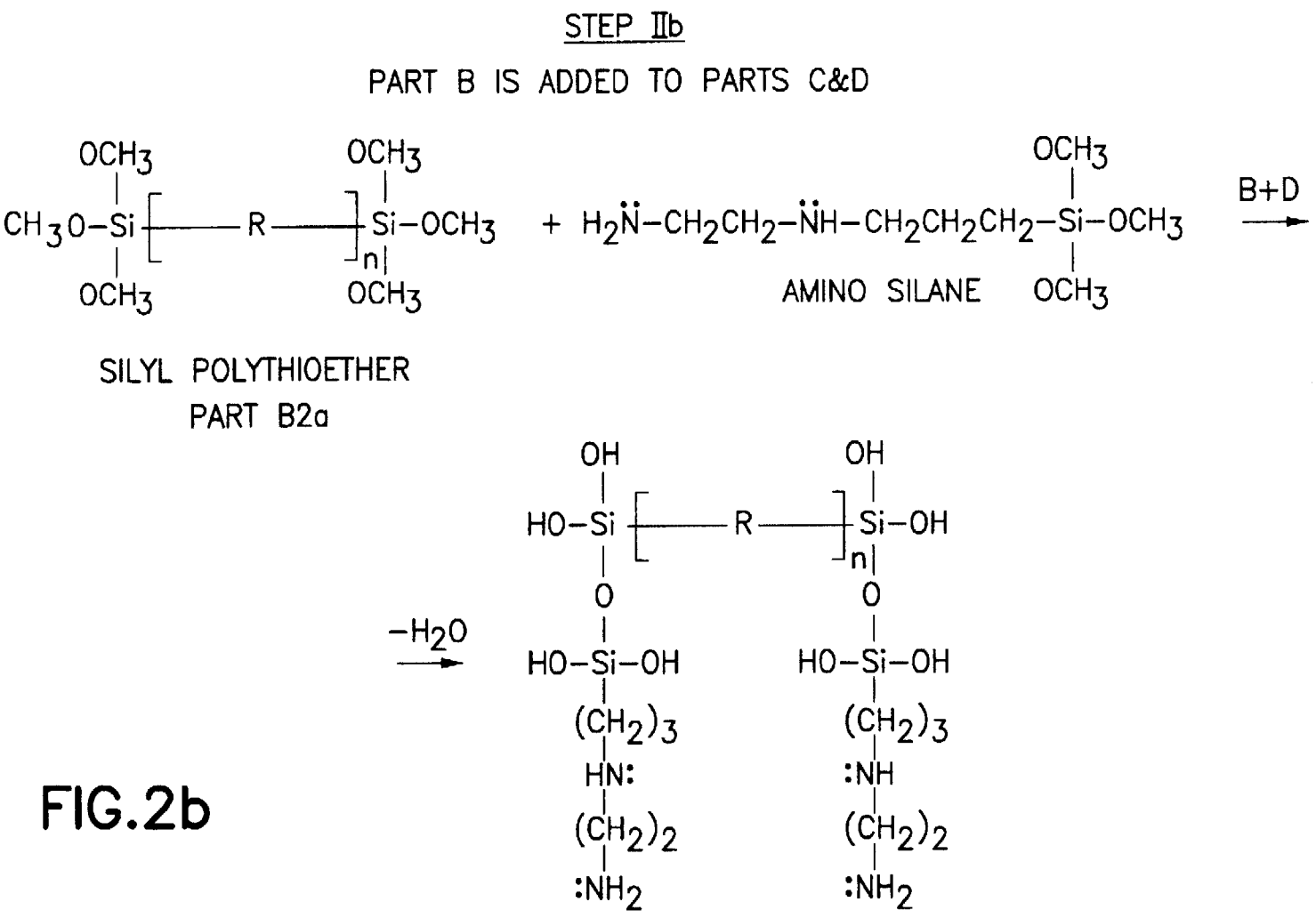
Figure 2C:
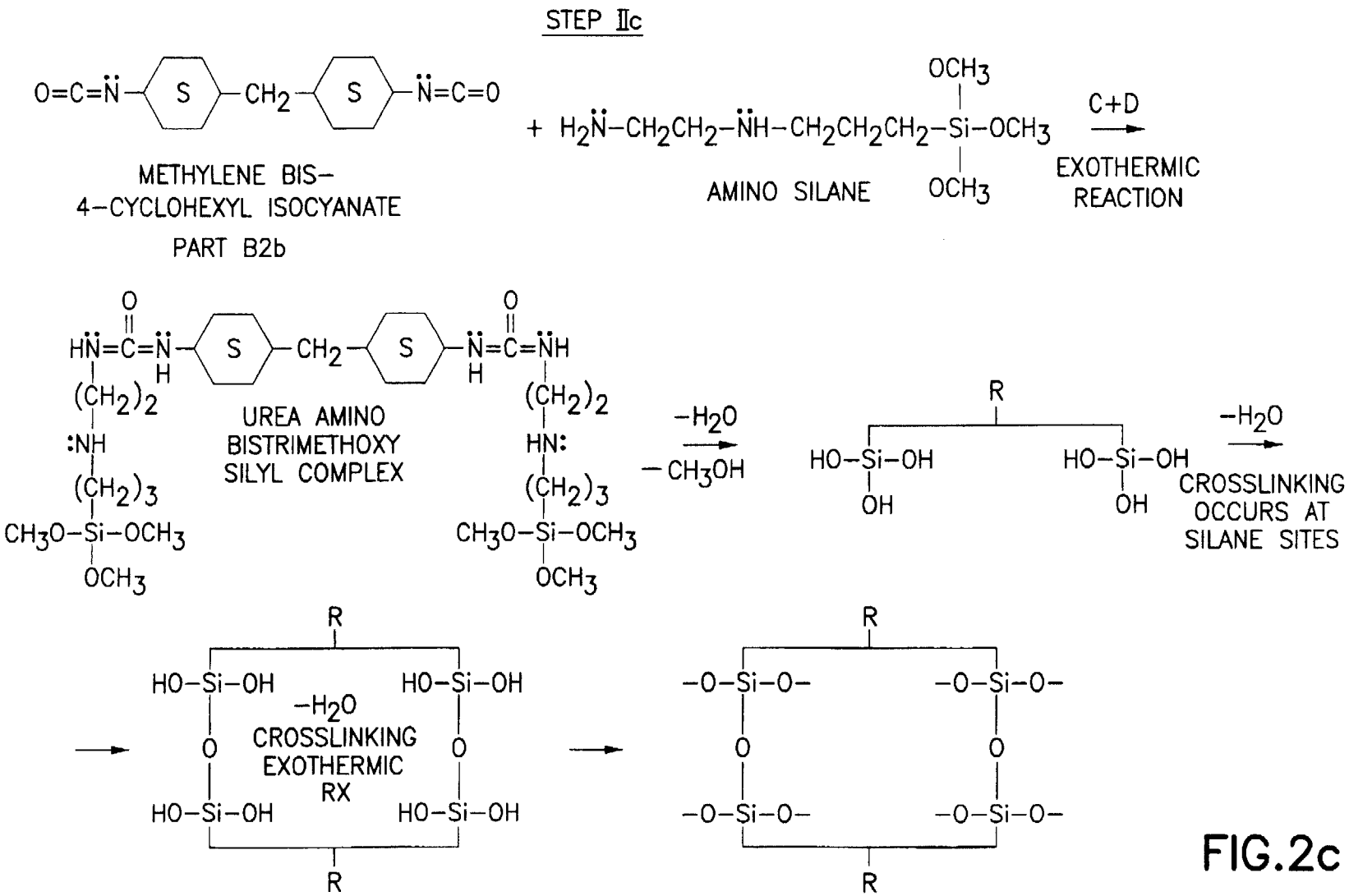

The present compositions comprise a low molecular weight fluid silyl-polythioether-polymer/methylene-bis-4cyclohexyl isocyanate, an amino silane monomer, 1-methoxy2-propanol acetate, diethylene toluene diamine, benzyl phthalate plasticizer and conductive sphere filler material.

The invention involves forming the following mixtures of ingredients as parts A, B, C, D and E:

Part A:
1. diethyl toluene diamine (Reactant)
2. 1-methoxy-2-propanol acetate (Solvent/Reactant)

Part B:
1. 1-methoxy-2-propanol acetate (Solvent/Reactant)
2. silyl polythioether polymer/methylene-bis-4-cyclohexyl isocyanate (Reactant)

Part C:
1. benzyl phthalate (or other liquid plasticizer)

Part D:
1. N-beta (aminoethyl)-γ-aminopropyltrimethoxy silane (liquid Reactant)

Part E:

1. Ag-coated hollow filler spheres.

These chemical compounds were mixed in the following steps, as illustrated in Figures:

Step I—Combine Part C with Part D and mix thoroughly (no Reaction);

Step II—Add Part B and mix well (Reaction);

Step III—Add Part E, and mix well;

Step IV—Add Part A and mix well (Reaction);

The chemical reactions taking place, when the above chemical compounds are added in the sequence indicated, are as illustrated in the accompanying drawings:

As illustrated by the accompanying drawings, the order in which the present ingredients/reactants are mixed with each other produces certain reactions and ties up certain reactive groups or sites whereby other reactions cannot occur when other normally-reactive compounds are eventually brought together. The Reactants of Part (B) when mixed with Parts (C) and (D), cause reactions to occur as illustrated under Mixing Step II of Chart 1. These Reactions have strong effects upon the structure and final properties of the formed elastomer. In fact, some percentage of each of these materials is present and has an effect upon the final properties of the elastomeric composition.

Step III involves mixing in the electroconductive filler, namely lightweight metal-coated polymer spheres, prior to the final Step IV. In Step IV, Part A comprising diethyltoluene diamine and 1-methoxy-2-propanol acetate are mixed with Parts B,C,D and E to produce yet another isocyanate-reactive monomer, as illustrated.

The liquid N-beta (aminoethyl) -γ-aminopropyltrimethoxy silane, which is Part D of the present composition and which is mixed with a liquid plasticizer in Step 1 of the present process, is a most important component since the stoichiometric content thereof determines the cure properties of the composition, such as curing temperature and time. Smaller amounts of the silane, Part D, such as between about 0.01% and 0.10% by weight, based upon the total weight of the composition, produce a composition which, when applied in the form of a 0.1 inch thick caulking layer, cures to a non-tacky solid form in about 7 days at ambient temperatures. Larger amounts of the silane, Part D, such as between about 0.18 and 1.50% by weight of the composition, produce a composition which, when similarly applied, cures to a non-tacky solid form in from about 4 hours down to a matter of minutes. While the higher content of the silane produces the most rapid curing time it tends to produce caulking compositions having reduced elastomeric properties.

As illustrated by the figures, the silane component, Part D, is required in four stoichiometric amounts to complete the reactions illustrated under Steps IIb and IIc. The diisocyanate component, Part B2, is required in at least three stoichiometric amounts to complete the reactions illustrated under Steps IIa, IIc and IV. The 1-methoxy-2-propanol acetate, part B1, is required in two stoichiometric amounts to complete the reaction illustrated under Step IIa. The diethyl toluene diamine, Part A1, is required in two stoichiometric amounts to complete the reaction of Step IV.

The amount of the liquid plasticizer, Part C, and of the liquid solvent, Part B1 and Part A2, will depend upon the molecular weight of the formed elastomer and upon the desired viscosity of the composition being formed, e.g., whether for use as a sprayable, coatable or caulking composition.

The liquid silyl-terminated polythioether/methylene bis-4-cyclohexyl isocyanate (Part B2) may be produced according to U.S. Pat. Nos. 4,366,307 or 4,960,844 of Products Research & Chemical Company, Glendale, Calif., the disclosures of which are hereby incorporated by reference.

All of the specific ingredients identified above are critical except for the benzyl phthalate (Part C) and the silver-coated filler spheres (Part E). Other liquid plasticizers can also be used, such as Monsanto HB-40 Plasticizer which is a hydrogenated aromatic mixture of terphenyls, quarterphenyls and higher polyphenyls, or Monsanto Santicizer 278 Plasticizer which is benzyl 3-hydroxy-1-isopropyl-2,2-dimethyl propyl ester isobutyrate of phthalic acid. Also other flowable conductive fillers can be used in place of the silver-coated filler spheres, particularly spheres coated with an inert noble metal, such as platinum or gold or an inert metallic compound, such as hafnium nitride or titanium nitride, applied as a thin surface coating by vacuum metalization or sputter-deposit techniques. The spherical configuration of the metal-coated filler particles imparts flow characteristics to the composition, even when present in large amounts, whereby the leveling properties permit the present gap fill compositions to flow and level in a gap before the composition cures and solidifies at room temperature. Moreover, the presence of the conductive coating as a thin surface deposit on the supporting spheres substantially reduces the amount of metal required by about 35–40% which, in the case of noble metals, substantially reduces the overall cost and weight. The metal coating must be oxidation-resistant and non-reactive with the liquid polymer, particularly the terminal groups thereof.

In summary, the novel process of the present invention involves the preparation of specific component parts or mixtures of ingredients, and the sequential combination of such parts in an order which produces predetermined monomers which are interreactive during low-temperature curing to form electro-conductive, chemically-modified, silyl-terminated polythioether-di-isocyanate elastomeric compositions as coatings, caulk fillers or gap-fills.

We claim:

1. Process for producing electroconductive silyl-terminated polythioether elastomer compositions which are rapidly curable at ambient temperatures, comprising the steps of:

(a) mixing together N-beta (aminoethyl)-γ-aminopropyl trimethoxy silane and a liquid plasticizer;

(b) reactin with said mixture a solution of a silyl-polythioether polymer and methylene-bis-4-cyclohexyl isocyanate in 1-methoxy-2-proponal acetate solvent in the absence of diethyl toluene diamine, under conditions which remove water and methanol to form a mixture comprising cross-linkable monomeric compounds;

(c) adding to said mixture a free-flowing electroconductive filler material; and (d) adding to the mixture of step (c), comprising the cross-linkage monomeric compounds of step (b), a solution of diethyl toluene diamine in 1-methoxy-2-propanol acetate under conditions which react the diethyl toluene diamine with a portion of the methylene-bis-cyclohexyl diisocyanate of step (b) to form another cross-linkable monomer, thereby producing an electroconductive composition, comprising a mixture of predetermined cross-linkable monomers, which is rapidly curable at low ambient temperatures to form an electronconductive, silyl-terminated polythioether elastomer composition.

2. An electroconductive silyl-terminated polythioether elastomer produced according to claim 1.

* * * * *